United States Patent [19]

Kotera

[11] Patent Number: 4,812,108

[45] Date of Patent: Mar. 14, 1989

[54] MAGNET PUMP

[75] Inventor: Masayuki Kotera, Mishima, Japan

[73] Assignee: Seikow Chemical Engineering & Machinery Ltd., Hyogo, Japan

[21] Appl. No.: 99,882

[22] Filed: Sep. 22, 1987

[30] Foreign Application Priority Data

Sep. 25, 1986 [JP] Japan ..... 61-146924

[51] Int. Cl.[4] ..... F04B 39/02

[52] U.S. Cl. ..... 417/368; 417/420; 417/423.13; 415/111; 415/176

[58] Field of Search ..... 417/365–368, 417/370, 420, 423 M, 423 P, 423 S, 423 T, 407; 415/104–106, 110, 111, 112, 176

[56] References Cited

U.S. PATENT DOCUMENTS

| | | | |
|---|---|---|---|
| 3,220,349 | 11/1965 | White | 417/365 X |
| 4,047,847 | 9/1977 | Oikawa | 417/420 X |
| 4,648,808 | 3/1987 | Havenstein | 417/420 X |

FOREIGN PATENT DOCUMENTS

| | | | |
|---|---|---|---|
| 0237868 | 9/1987 | European Pat. Off. | 415/112 |
| 55-48794 | 11/1980 | Japan . | |

*Primary Examiner*—Carlton R. Croyle
*Assistant Examiner*—Eugene L. Szczecina, Jr.
*Attorney, Agent, or Firm*—Larson and Taylor

[57] ABSTRACT

A magnet pump comprising a front casing, a rear casing provided behind the front casing with a partition wall interposed therebetween, a rotary shaft extending from the front casing into the rear casing and supported by a bearing device provided in the partition wall, an impeller fixed to the rotary shaft within the front casing, a driven magnet drivingly connected to the rotary shaft within the rear casing and a drive magnet provided outside the rear casing and drivingly rotatable by a motor, the magnet pump being characterized in that the bearing device is formed at an intermediate portion thereof with lubricant supply channels, the partition wall having bores opposed to the rear plate of the impeller for guiding the liquid within the front casing into the rear casing therethrough, the rear casing having a supply bore for supplying a lubricant from outside into the rear casing therethrough, guide blades for guiding the liquid from the rear casing into the channels of the bearing device being provided on at least one of the surface of the partition wall and the surface of the rear casing which define the interior space of the rear casing.

5 Claims, 5 Drawing Sheets

MAGNET PUMP

BACKGROUND OF THE INVENTION

1. Field of the Invention

The present invention relates to a magnet pump, and more particularly to a magnet pump comprising a front casing, a rear casing provided behind the front casing with a partition wall interposed therebetween, a rotary shaft extending from the front casing into the rear casing and supported by a bearing device provided in the partition wall, an impeller fixed to the rotary shaft within the front casing, a driven magnet drivingly connected to the rotary shaft within the rear casing and a drive magnet provided outside the rear casing and drivingly rotatable by a motor.

2. Description of the Prior Art

Conventional magnet pumps of the type described above having a single bearing device are generally not adapted to supply a lubricant to the bearing device, which is limited in capacity and is therefore prone to damage, consequently limiting the use of the pump. Further even if the bearing device is adapted for lubrication (see Examined Japanese Utility Model Publication SHO No. 55-48794), the lubricant is supplied to the bearing device only through a channel extending through the partition wall between the front casing and the rear casing. If the lubricant supplied in this case is a slurry or a sludge-containing liquid, the bearing device is susceptible to damage or a break, possibly rendering the pump unusable and limiting the use of the pump.

SUMMARY OF THE INVENTION

The main object of the present invention is to provide a magnet pump including a bearing device which can be lubricated with a portion of the liquid sent by the impeller to its discharge port and/or a lubricant (such as water) supplied from outside, the pump further being so adapted that the lubricant can be forcibly guided into the bearing device, whereby the pump is made usable for a prolonged period of time with good stability for slurries, sludge-containing liquids and various other liquids.

Other objects of the invention will become apparent from the following description.

The above and other objects of the invention can be fulfilled by a magnet pump comprising a front casing, a rear casing provided behind the front casing with a partition wall interposed therebetween, a rotary shaft extending from the front casing into the rear casing and supported by a bearing device provided in the partition wall, an impeller fixed to the rotary shaft within the front casing, a driven magnet drivingly connected to the rotary shaft within the rear casing and a drive magnet provided outside the rear casing and drivingly rotatable by a motor, the magnet pump being characterized in that the bearing device is formed at an intermediate portion thereof with lubricant supply channels, the partition wall having bores opposed to the rear plate of the impeller for guiding the liquid within the front casing into the rear casing therethrough, the rear casing having a supply bore for supplying a lubricant from outside into the rear casing therethrough, guide blades for guiding the liquid from the rear casing into the channels of the bearing device being provided on at least one of the surface of the partition wall and the surface of the rear casing which define the interior space of the rear casing.

Preferably the guide blades provided on the partition wall surface extend toward the respective channels of the bearing device, and at least one of the guide blades extends from a position close to the outlet of the liquid guiding bore of the partition wall.

According to a preferred embodiment of the invention, the guide blades provided on the surface of the rear casing extend toward the bearing device, and at least one of the guide blades extends from a position close to the supply bore of the rear casing.

At least one bearing member can be included in the bearing device. Preferably, for example, the bearing device comprises a bearing holder in the partition wall and a bearing bushing supported by the holder. In this case, the bushing has liquid channels formed in its inner surface and extending longitudinally of the rotary shaft, radial grooves formed in its opposite end faces and communicating with the respective liquid channels, and inlet ports formed in the wall of the bushing at an intermediate portion thereof and communicating with the respective liquid channels. The bearing holder is formed with openings for causing the inlet ports to communicate with the interior space of the rear casing therethrough. The inlet ports and the openings provide the lubricant supply channels.

The liquid channels extending longitudinally of the rotary shaft need not always extend straight but may extend helically or otherwise. The radial grooves need not extend radially straight either.

According to the present invention, the rotation of the drive magnet by a motor rotates the driven magnet, which in turn rotates the rotary shaft and the impeller. During the operation of the pump, the supply bore of the rear casing is closed, with the liquid guiding bores of the partition wall held open, permitting the liquid within the front casing to flow into the rear casing, in which the liquid is whirled by the rotation of the driven magnet. The liquid is forcibly led into the lubricant supply channels of the bearing device by the guide blades provided in the interior space of the rear casing to lubricate the device.

When the liquid in the pump casing is a slurry, sludge-containing liquid or the like and is not usable as a lubricant as it is, water or other lubricant can be supplied via the supply bore of the rear casing, with the liquid guiding bores of the partition wall held open or closed in a suitable manner.

Thus according to the present invention, a lubricant can be supplied to the bearing device. Examples of useful lubricants are portion of the liquid sent toward the pump discharge port by the impeller, and other lubricant, such as water, supplied from outside. These two lubricants are usable in combination. Moreover, the lubricant can be forcibly supplied to the bearing device by the guide blades. Consequently, the pump is usable for a prolonged period of time with good stability for slurries, sludge-containing liquids and various other liquids.

DESCRIPTION OF THE PREFERRED EMBODIMENTS

Figure 1:
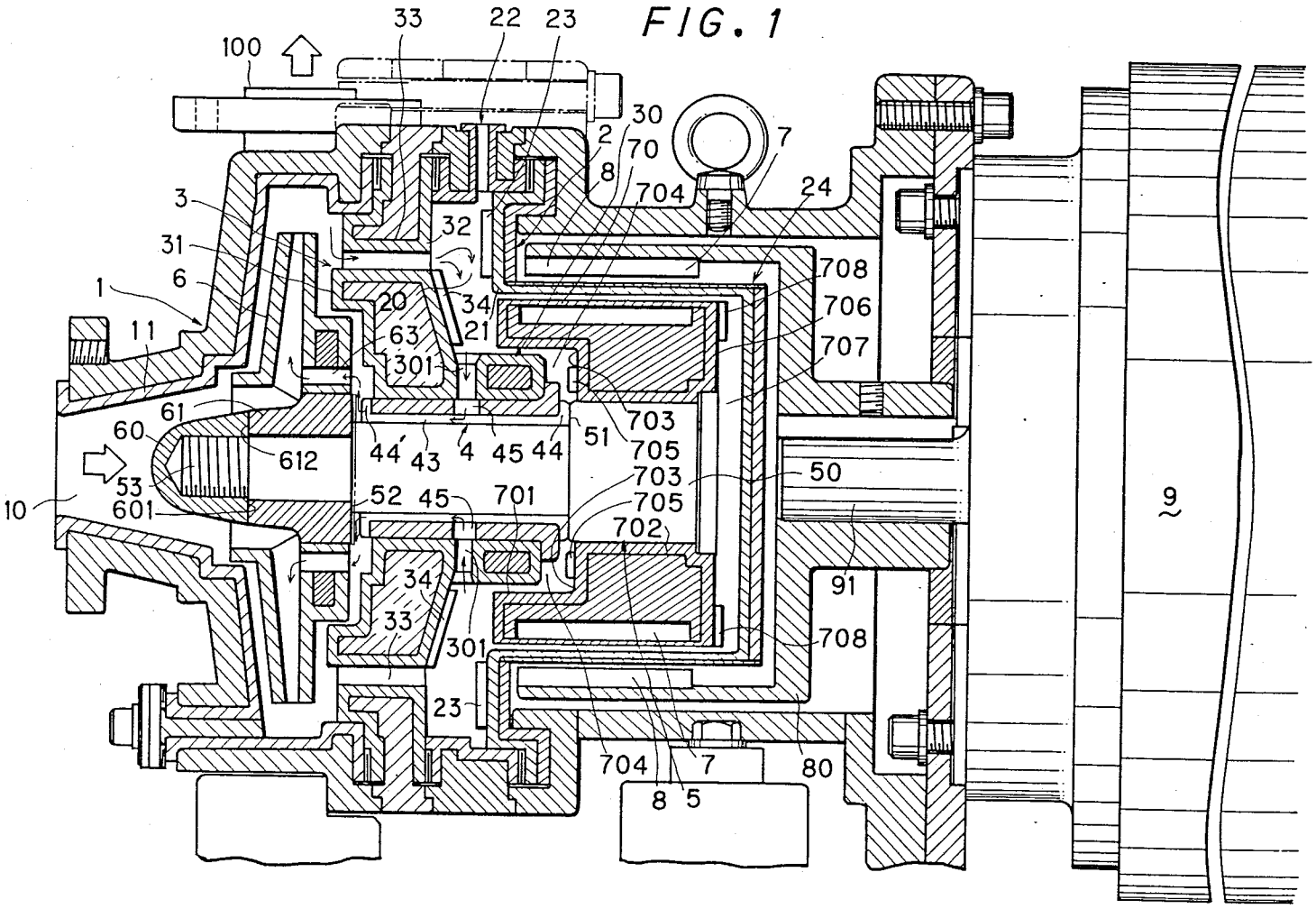
FIG. 1 is a sectional view showing an embodiment of the invention.

The illustrated pump is a corrosion-resistant centrifugal magnet pump for use with slurries and sludge-containing corrosive liquids.

The term "corrosion-resistant" as used herein refers to the property of being free from or not susceptible to attacking by acids, alkalis, salts, organic solvents, etc., or to resistance to chemicals. This means that the material concerned does not, or is unlikely to, deteriorate, crack, embrittle, discolor, permit penetration of some liquid thereinto or become otherwise degraded.

The pump comprises a front casing 1, a rear casing 2, a partition wall 3 between the two casings, a bearing bushing 4 supported by a bearing holder 30 provided in the partition wall 3, a rotary shaft 5 rotatably supported by the bearing bushing 4 and extending from the front casing 1 into the rear casing 2, an impeller 6 fixed to the rotary shaft 5 within the front casing 1, a driven magnet 7 drivingly connected to the shaft 5 within the rear casing 2 and a drive magnet 8 provided around the rear casing.

Figure 10:
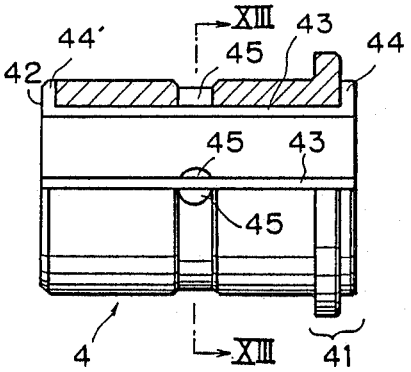
FIG. 10 is a side elevation partly in vertical section and showing the bearing bushing of the pump.
Figure 11:
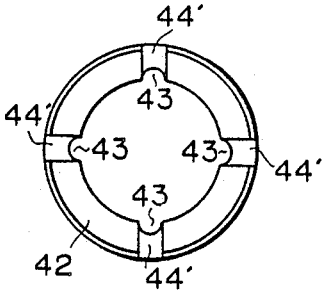
FIG. 11 is a front view showing the bearing bushing of FIG. 10.
Figure 12:
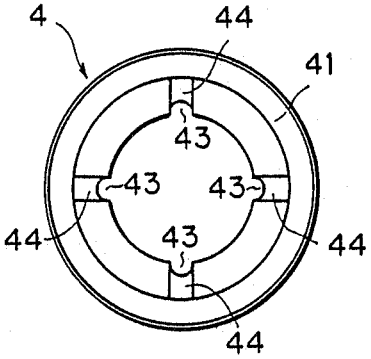
FIG. 12 is a rear view showing the bearing bushing of FIG. 10.
Figure 13:
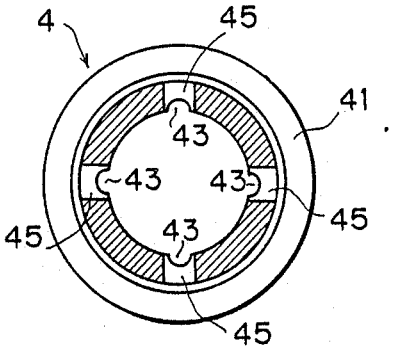
FIG. 13 is a view in section taken along the line XIII—XIII in FIG. 10.

The front casing 1, the rear casing 2 and the partition wall 3 are respectively covered with surface layers 11, 21, and 31, 32 which are to be exposed to a liquid. These layers are prepared from a corrosion-resistant synthetic resin. Examples of such resins are fluorocarbon resins such as polytetrafluoroethylene (PTFE), polychlorotrifluoroethylene (PCTFE), polyvinylidene fluoride (PVDF), polyvinyl fluoride (PVF), tetrafluoroethylene-hexafluoropropylene copolymer (FEP), tetrafluoroethylene-ethylene copolymer (ETFE), tetrafluoroethylene-perfluoroalkyl vinyl ether copolymer (PFA), chlorotrifluoroethylene-ethylene copolymer (PCTFE) and tetrafluoroethylene-hexafluoropropylene-perfluoroalkyl vinyl ether copolymer (EPE). The other portions of the casings and the wall are made of iron or other suitable metal. The bearing bushing 4 is made of a corrosion-resistant material. Examples of such materials are ceramic materials including alumina, silicon carbide, silicon nitride and zirconia; synthetic resins including fluorocarbon resins such as PTFE, PCTFE, PVDF, PVF, FEP, ETFE, PFA, ECTFE and EPE, with or without a filler (e.g. carbon) incorporated therein, polyamide resins known under the trademarks of Nylon, etc. and superhigh-density polyethylene; and carbon and high-density carbon. The bushing 4 is generally in the form of a hollow cylinder and has at its rear end a flange 41 (see FIG. 10) in contact with and supported by the rear end face of the bearing holder 30. The bushing has a front end face 42 (see FIG. 10) opposed to the front casing 1. The flange 41 is also in contact with a stepped portion 51 of a large-diameter portion 50 of the shaft 5 at its rear end.

The bearing bushing 4 has four liquid channels 43 formed in its inner surface longitudinally of the rotary shaft 5 and spaced apart equidistantly, radial grooves 44, 44' formed respectively in the rear end face of the flange 41 and the front end face 42 and communicating with the respective liquid channels 43, and inlet ports 45 formed in its wall at an intermediate portion thereof and communicating with the respective liquid channels 43. In corresponding relation to the inlet ports 45, the bearing holder 30 of the partition wall 3 is formed with openings 301 for causing the inlet ports 45 to communicate with the interior space of the rear casing 2 therethrough.

When required, the liquid channels 43 may helically or otherwise extend longitudinally of the rotary shaft 5, while the radial grooves 44, 44' need not always be accurately arranged radially of the bushing 4.

The rotary shaft 5 is made of a ceramic material such as alumina, silicon carbide, silicon nitride or zirconia and is supported at an intermediate portion thereof by the bushing 4 as already mentioned. Examples of other materials useful for the shaft 5 are corrosion-resistant metals and alloys thereof such as stainless steel, tantalum and alloys thereof, titanium and alloys thereof, nickel-base alloys available under the trademarks of Hastelloy, Inconel, etc. and iron-base alloy available under the trademark of Carpenter.

The front end of the shaft 5 is positioned within the front casing 1. The impeller 6 is fitted around the front end which is square in cross section, and is in contact with a stepped portion 52 of the shaft 5. In cross section, the shaft front end need not always be square but may be of other polygonal shape, e.g. hexagonal. Alternatively, the impeller may be keyed to the shaft end.

The impeller 6 is fastened to the shaft by an impeller nut 60 in the form of a cap nut and screwed on the shaft end which is externally threaded as indicated at 53.

The impeller 6 comprises an insert 61 positioned in the center thereof, and the remaining synthetic resin portion (including blades) 62 around the insert. The insert 61 is made of a ceramic material such as alumina, silicon carbide, silicon nitride or zirconia. The resin portion 62 is made of a fluorocarbon resin such as PTFE, PCTFE, PVDF, PVF, FEP, ETFE, PFA, ECTFE or EPE or other corrosion-resistant synthetic resin.

The insert 61 has a shaft bore 610 conforming to the front end of the shaft 5 in cross section and further has a smooth rear end face 611 serving as a bearing face for thrust acting rearwardly of the impeller 6. The thrust bearing face 611 is opposed to the front end face 42 of the bearing bushing 4 on the partition wall 3 serving as a thrust bearing face. The rear end face 611 may be flush with the surface of the rear plate of the impeller as indicated in a solid line in FIGS. 1 and 2, or may be projected rearward as indicated in a phantom line in these drawings.

The insert 61 has a front end face 612 projecting forward and formed with a multiplicity of nut engaging projections 613 in a radial arrangement. The projections 613 gradually project toward the impeller nut 60 in the direction $\alpha$ of tightening rotation of the nut and subsequently recessed in a direction away from the impeller nut 6.

The impeller nut 60 is made of a corrosion-resistant material, such as one of the fluorocarbon resins mentioned above, which is lower in hardness than the material of the impeller insert 61, so that when the nut 60 is tightened up, the projections 613 on the front end face of the impeller insert 61 bite into the nut end face 601. Consequently, the nut will not be readily loosened by the vibration of the pump or when the pump is reversely rotated, intentionally or by a reverse flow from the discharge pipe toward the pump upon stopping of the pump.

Figure 5:
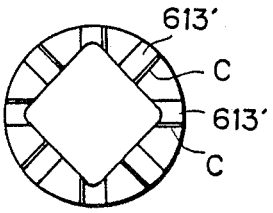
FIG. 5 is a view showing another example of projections on the front end face of the insert.
Figure 6:
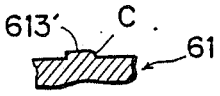
FIG. 6 is a view in section showing the projection of FIG. 5.
Figure 7:
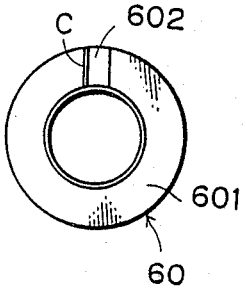
FIG. 7 is a rear view showing another example of impeller nut.
Figure 8:
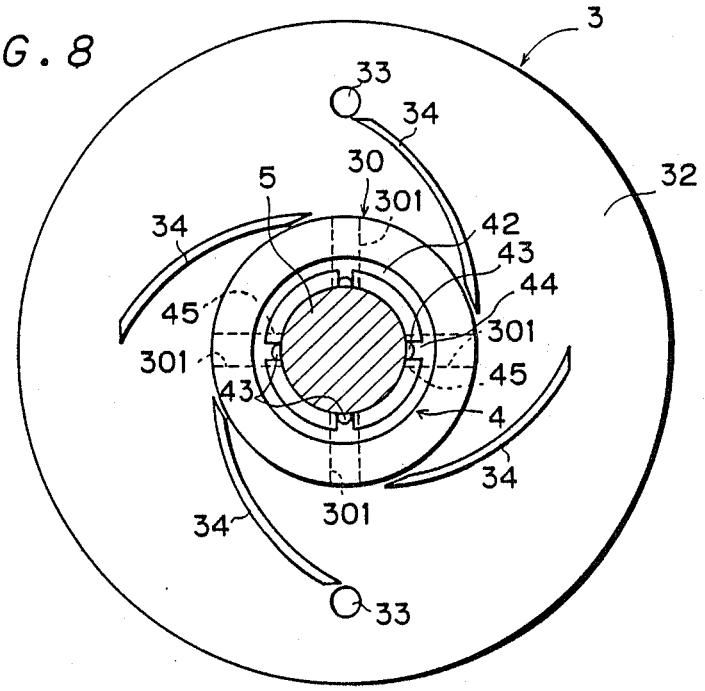
FIG. 8 is a view showing part of a partition wall, bearing holder and bearing bushing included in the pump of FIG. 1 as they are seen from the rear side.
Figure 9:
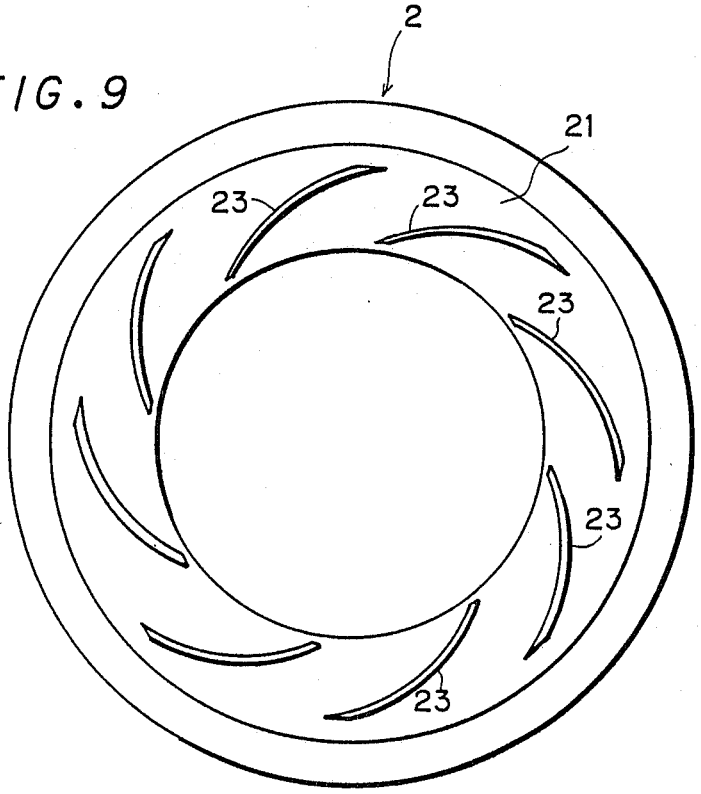
FIG. 9 is a fragmentary front view showing a rear casing included in the pump of FIG. 1.

Instead of the projections 613, projections 613' may be formed on the front end face 612 of the insert 60 as seen in FIGS. 5 and 6. Each projection 613' is slightly chamfered, as indicated at C, at one side thereof opposite to the direction $\alpha$. The end face 601 of the impeller nut 60 may also be formed with at least one projection 602, such as one resembling the projection 613', which is chamfered at the side thereof opposite to the chamfered side of the projection 613', as indicated at C in FIG. 7.

The impeller insert 61 is formed with a multiplicity of recessed portions (small holes 614, large holes 615, cutouts 616, etc.), in which the synthetic resin portion 62 partially lodges to produce an anchor effect. Consequently, the insert 61 is firmly bonded to the resin portion 62.

Indicated at 63 are balance holes for holding the impeller in balance against thrust acting toward a pump suction port 10.

The partition wall 3 has upper and lower two bores 33 opposed to the rear plate of the impeller 6 for guiding the liquid within the front casing 1 into the rear casing 2 therethrough.

The rear casing 2 has a supply bore 22 for supplying a lubricant from outside into the rear casing therethrough.

The partition wall 3 has four guide blades 34 on the surface thereof opposed to an interior space 20 of the rear casing 2. These guide blades 34 are spaced apart equidistantly around the bearing holder 30 and extend toward the respective openings 301 formed in the bearing holder 30. Two of the four blades each extend from a position close to the outlet of the liquid guiding bores 33 in the partition wall 3. A plurality of guide blades 23 are also formed on the wall surface of the partition wall 3 opposed to the interior space 20 of the rear casing 2. These blades 23 are spaced apart equidistantly around the bearing holder 30 and arranged at a larger distance therefrom than the blades 34 on the partition wall 3. All the blades 23 extend toward the holder 30. One of the blades 23 extends from a position close to the supply bore 22 in the rear casing 2.

The guide blades 34 and 23 are all made of corrosion-resistant resin.

The driven magnet 7 is drivingly connected to the rotary shaft 5 by a magnet holding member 70 made of a corrosion-resistant synthetic resin such as fluorocarbon resin. Since the magnet 7 is thus connected to the large-diameter portion 50 of the shaft 5 over a wide area, the magnet can be connected thereto with correspondingly great strength and thereby made to withstand a great rotational torque. The large-diameter portion 50 forms the stepped portion 51, which provides a thrust bearing face opposed to the bushing 4 since the shaft is made of ceramic material as already stated. The magnet 7 is enclosed in the member 70.

The drive magnet 8 is connected to the drive shaft 91 of a motor 9 by a suitable magnet holding member 80.

The motor 9, when energized, rotates the drive magnet 8, which in turn rotates the driven magnet 7, therefore the rotary shaft 5 and the impeller 6. A liquid is drawn into the front casing 1 through the pump suction port 10 and delivered from a pump discharge port 100.

When the liquid through the pump is usable as it is as a bearing lubricant, the supply bore 22 is closed during the operation of the pump, and only the liquid in the front casing 1 is supplied to the rear casing 2 through the guiding bores 33 as the lubricant. If the liquid is not usable as it is as the lubricant, other lubricant (such as water) is supplied from the supply bore 22 in the rear casing to dilute the liquid, or alternatively, the lubricant is fed from the supply bore 22 only, with the liquid guiding bores 33 closed in a suitable manner.

The liquid within the rear casing is whirled by the rotation of the driven magnet holding member 70. The liquid supplied from the guiding bores 33 is forcibly guided into the openings 301 in the bearing holder 30 chiefly by the guide blades 34. The liquid supplied from the bore 22 is similarly guided into the openings 301 mainly by the guide blades 23. The liquid then flows into the bearing bushing 4 via the inlet ports 45 for lubrication and cooling.

The magnet holding member 70, which is in the form of a hollow cylinder of uniform outside diameter, has a small inside diameter portion 702 and a large inside diameter portion 701 extending forwardly of the small inside diameter portion 702. The small inside diameter portion 702 is drivingly connected to the rear end portion of the rotary shaft 5 axially thereof. The front end portion of the large inside diameter portion 701 is positioned around the rear end portion, circular in cross section, of the bearing holder 30, with a small clearance formed therebetween.

Figure 2:
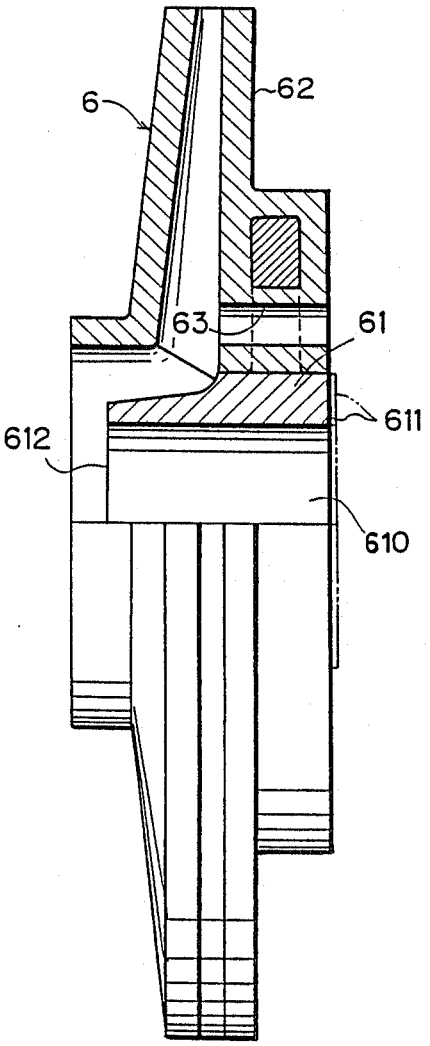
FIG. 2 is a side elevation partly in vertical section of an impeller included in the corrosion-resistant magnet pump shown in FIG. 1.
Figure 3:
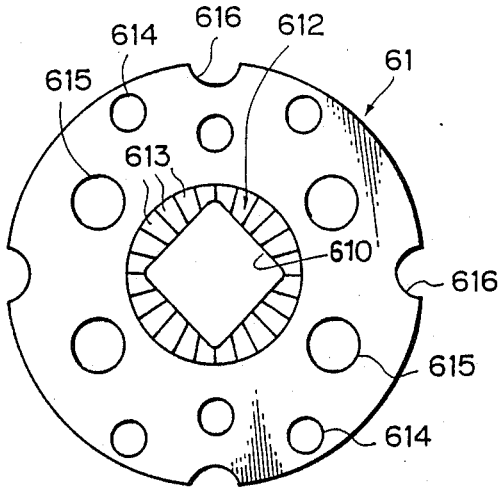
FIG. 3 is a front view showing the impeller insert of FIG. 2.
Figure 4:
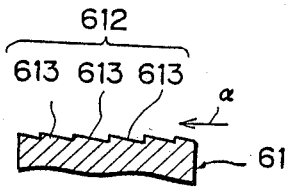
FIG. 4 is a development in section showing objections on the front end face of the insert of FIG. 3.
Figure 14:
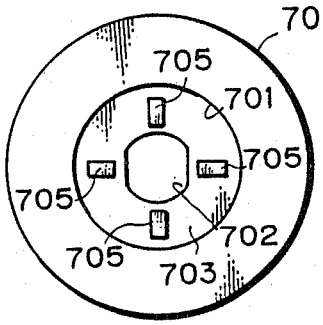
FIG. 14 is a front view showing a driven magnet holding member of the pump shown in FIG. 1.

A stepped portion 703 extending from the portion 701 to the portion 702 is provided with radial blades 705 for giving an increased liquid pressure to a space 704 in front of the stepped portion (see FIGS. 1 and 14).

Figure 15:
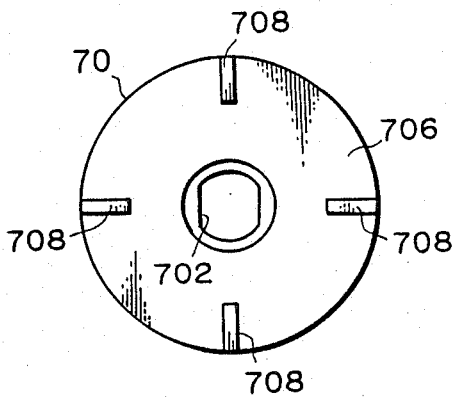
FIG. 15 is a rear view of the member of FIG. 14.

The holding member 70 has a rear end face 706 which is provided with radial blades 708 arranged along its outer periphery for giving a reduced liquid pressure to a space 707 in the rear of the end face 706 (FIGS. 1 and 15).

The rear casing 2 includes the aforementioned surface layer 21 of synthetic resin and a cover 24 fitted around the layer 21 and made of a nonmagnetic metal such as nickel-base alloys available under the trademark of Hastelloy, Inconel or the like.

The rear casing 2 has a bottom opposed to the driven magnet holding member 70.

When the member 70 is rotated for the operation of the pump, the blades 705 act to give an increased liquid pressure to the space 704 in front of the stepped portion 703, while the blades 708 act to give a reduced liquid pressure to the rear space 707. Consequently, a liquid pressure difference occurs between the spaces in front and rear of the member 70, exerting on the member 70 thrust acting in a direction away from the pump suction port 10. This correspondingly diminishes the thrust acting toward the pump suction port 10.

Figure 16:
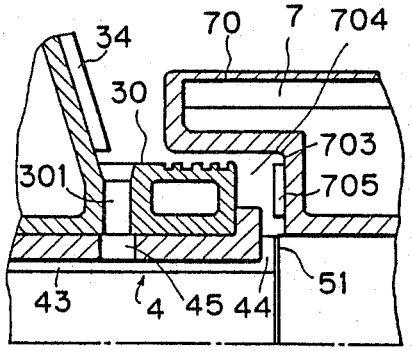
FIG. 16 is a view showing a labyrinth between the bearing holder on the partition wall and the driven magnet holding member.
Figure 17:
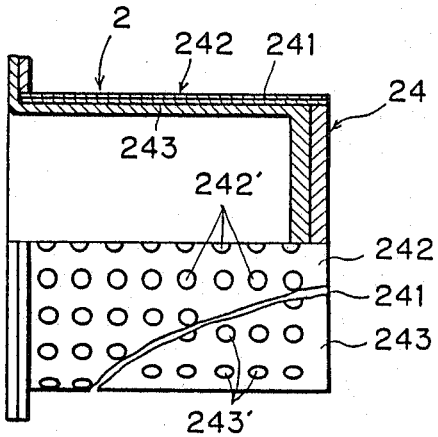
FIG. 17 is a side elevation partly broken away and showing the rear casing.

The clearance between the rear end portion of the bearing holder 30 and the front end portion of the magnet holding member 70 provided therearound can be made to have a labyrinth, for example, as shown in FIG. 16. The labyrinth then gives a further increased liquid pressure to the space 704 in front of the stepped portion of the member 70 to mitigate the thrust toward the suction port 10 to a greater extent.

The cylindrical portion 24 of the metal cover of the rear casing 2 which portion is positioned between the driven and drive magnets 7 and 8 and greatly affected by the magnetic flux comprises two metal layers 242, 243 and an electrical insulation layer 241 sandwiched therebetween. The metal layers 242, 243 are formed with a multiplicity of holes 242', 243', respectively, which are so arranged that the holes of one layer do not overlap those of the other layer. The metal layers 242, 243 can be obtained by shaping a thin metal sheet into a cylinder. The holes 242', 243' can be easily formed by punching the sheet before shaping.

The illustrated insulation layer 241 is obtained by fitting a heat-shrinkable electrical insulation tube (for example of silicone resin, vinyl chloride resin, PFA, FEP or the like) around the inner metal layer 243 and thereafter heating the metal layer. The metal layer 242 is then fitted over the resulting assembly.

Instead of the tube 241, a coating composition of epoxy resin, vinyl chloride resin or acrylic resin, varnish of silicone resin or fluorocarbon resin or the like may be applied to the inner metal layer 243 to form an electrical insulation coating layer thereon. The tube and the coating layer may be provided in combination.

As compared with a single metal layer equal in thickness to the combined thickness of the metal layers 242, 243 and formed with holes in the same ratio as the holes 242', 243', the rear casing 2 of the above construction is reduced by a maximum of about 50% in eddy current loss while retaining the same strength or pressure resistance as the single metal layer.

I claim:

1. A magnet pump comprising a front casing, a rear casing provided behind the front casing with a partition wall interposed therebetween, a rotary shaft extending from the front casing into the rear casing and supported by a bearing device provided in the partition wall, an impeller fixed to the rotary shaft within the front casing, a driven magnet drivingly connected to the rotary shaft within the rear casing and a drive magnet provided outside the rear casing and being drivingly rotatable by a motor, the bearing device being formed at an intermediate portion thereof with lubricant supply channels, the partition wall having bores therethrough, opposed to the rear plate of the impeller for guiding the liquid within the front casing into the rear casing, the rear casing having a supply bore therethrough for supplying a lubricant from outside into the rear casing, guide blades for guiding the liquid from the rear casing into the channels of the bearing device being provided on at least one of the surface of partition wall and the surface of the rear casing which define the interior space of the rear casing, and said magnet pump further comprising a driven magnet holding member, a space formed between the rear end face of the driven magnet holding member and the rear wall of the rear casing, the driven magnet holding member having a small inside diameter portion drivingly connected to the rotary shaft axially thereof and a large inside diameter portion extending forwardly of the small inside diameter portion and defining, with the small inside diameter portion, a stepped portion, the front end portion of the large inside diameter portion being positioned around the bearing holder with a small clearance formed therebetween, the stepped portion defined by the large inside diameter portion and the small inside diameter portion being provided with blades for providing increased liquid pressure in a space between for stepped portion and the small clearance, and the bearing holder being provided with blades in the rear of the end face thereof for providing reduced liquid pressure in the space between the rear of the end face thereof and the rear wall of the rear casing.

2. A pump as defined in claim 1 wherein the guide blades provided on the partition wall surface extend toward the channels of the bearing device, and at least one of the guide blades extends from a position close to the outlet of the guiding bore in the partition wall.

3. A pump as defined in claim 1 wherein the guide blades provided on the surface of the rear casing extend toward the bearing device, and at least one of the guide blades extends from a position close to the supply bore of the rear casing.

4. A pump as defined in claim 1 wherein the bearing device has a bearing holder provided on the partition wall and a bearing bushing held by the holder, and the bushing has liquid channels formed in its inner surface and extending longitudinally of the rotary shaft, radial grooves formed in its opposite end faces and each communicating with the liquid channel, and inlet ports formed in the wall of the bushing at an intermediate portion thereof and each communicating with the liquid channel, the bearing holder being formed with openings holding the inlet ports in communication with the interior space of the rear casing, the inlet ports and the openings providing the lubricant supply channels.

5. A magnet pump comprising a front casing, a rear casing provided behind the front casing with a partition wall interposed therebetween, a rotary shaft extending from the front casing into the rear casing and supported by a bearing device provided in the partition wall, an impeller fixed to the rotary shaft within the front casing, a driven magnet drivingly connected to the rotary shaft within the rear casing, a driven magnet holding member and a drive magnet provided outside the rear casing and being drivingly rotatable by a motor, the bearing device being formed at an intermediate portion thereof with lubricant supply channels and having a bearing holder provided on the partition wall and a bearing bushing held by the holder, the bushing having liquid channels formed in the inner surface thereof and extending longitudinally of the rotary shaft, radial grooves formed in the opposite end faces thereof and each communicating with the liquid channel, and inlet ports formed in the wall of the busing at an intermediate portion thereof and each communicating with the liquid channel, the bearing holder being formed with openings holding the inlet ports in communication with the interior space of the rear casing, the inlet ports and the openings constituting said lubricant supply channels, the partition wall having bores therethrough opposed to the rear plate of the impeller for guiding the liquid within the front casing into the rear casing, the rear casing having a supply bore therethrough for supplying a lubrication from outside into the rear casing, guide blades for guiding the liquid from the rear casing into the channels of the bearing device being provided on at least one of the surface of the partition wall and the surface of the rear casing which defines the interior space of the rear casing, the guide blades provided on the partition wall surface extending toward the channels of the bearing device, and at least one of the guide blades extending from a position close to the outlet of the guiding bore in the partition wall, the guide blades provided on the surface of the rear casing extending toward the bearing device, and at least one of the guide blades extending from a position close to the supply bore of the rear casing, said magnet pump further including a space formed between the rear end face of the driven magnet holding member and the rear wall of the rear casing, the driven magnet holding member having a small inside diameter portion drivingly connected to the rotary shaft axially thereof and a large inside diameter portion extending forwardly of the small inside diameter portion and defining, with the small inside diameter portion, a stepped portion, the front end portion of the large inside diameter portion being positioned around the bearing holder with a small clearance formed therebetween, the stepped portion defined by the large inside diameter portion and the small inside diameter portion being provided with blades for providing increased liquid pressure in a space between the stepped portion and the small clearance and the bearing holder being provided with blades in the rear of the end face thereof for providing a reduced liquid pressure in the space between the rear of the end face thereof and the rear wall of the rear casing.

* * * * *